US008636142B2

(12) United States Patent
Apps

(10) Patent No.: US 8,636,142 B2
(45) Date of Patent: Jan. 28, 2014

(54) STACKABLE LOW DEPTH TRAY

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 40 days.

(21) Appl. No.: 12/556,616

(22) Filed: Sep. 10, 2009

(65) Prior Publication Data

US 2011/0056861 A1 Mar. 10, 2011

(51) Int. Cl.
*B65D 75/00* (2006.01)

(52) U.S. Cl.
USPC ..... 206/203; 220/509

(58) Field of Classification Search
USPC ..... 206/427, 503, 203, 509, 510, 480, 485, 206/511, 821, 518; 220/516–519, 509, 505, 220/23.88, 771, DIG. 15, 507, 512, 513, 220/515, 514
See application file for complete search history.

(56) References Cited

U.S. PATENT DOCUMENTS

| | | | |
|---|---|---|---|
| 820,445 | A | 5/1906 | Speer |
| D103,862 | S | 3/1937 | Randall et al. |
| 2,411,673 | A | 11/1946 | Vechey, Jr. |
| D147,981 | S | 11/1947 | Lehman |
| D152,907 | S | 3/1949 | Richards |
| 2,588,805 | A | 3/1950 | Cross |
| 2,512,855 | A | 6/1950 | Erickson |
| 2,530,481 | A | 11/1950 | Rawn, Jr. |
| 2,526,335 | A | 12/1950 | Diechert |
| 2,535,493 | A | 12/1950 | Gerber |
| 2,626,079 | A | 1/1953 | Keller |
| D172,664 | S | 7/1954 | Emery |
| 2,743,030 | A | 4/1956 | Read, Jr. |
| 2,840,256 | A | 6/1958 | Cobb, Jr. |
| 2,928,530 | A | 3/1960 | Sauey |
| 2,935,222 | A | 5/1960 | O'Connell |
| 2,970,715 | A | 2/1961 | Kappel et al. |
| D189,891 | S | 3/1961 | Schilling et al. |

(Continued)

FOREIGN PATENT DOCUMENTS

| | | |
|---|---|---|
| BE | 680197 | 10/1966 |
| BE | 693216 | 1/1967 |

(Continued)

OTHER PUBLICATIONS

European Search Report for European Application No. 09156468.2, May 27, 2009.

(Continued)

*Primary Examiner* — Jacob K Ackun
*Assistant Examiner* — Jenine Pagan
(74) *Attorney, Agent, or Firm* — Carlson, Gaskey & Olds

(57) ABSTRACT

A tray includes a base, a pair of opposed side walls and a plurality of interior columns between the side walls. A plurality of dividers connect the interior columns to one another and to the side walls. Side columns project upward from the side walls. The side walls include an upper portion and a plurality of spaced-apart lower portions, thus reducing the weight of the tray while maintaining the stability of the tray. Optionally, the base could include a plurality of base walls connected by co-planar vertical ribs. The dividers include upper wall portions extending continuously between interior columns and/or an interior column and a side column and/or an interior column and an end column. The dividers include spaced apart lower wall portions each connected to one of the vertical ribs connected adjacent base walls.

21 Claims, 9 Drawing Sheets

(56) References Cited

U.S. PATENT DOCUMENTS 2,974,819 A 3/1961 Melville
2,979,222 A 4/1961 Levine
3,009,579 A 11/1961 Ettlinger, Jr.
3,055,531 A 9/1962 De Chelbor
3,055,542 A 9/1962 Russo
3,092,284 A 6/1963 Stout
D195,702 S 7/1963 Russo
3,151,762 A 10/1964 Vidal
3,155,268 A * 11/1964 Fogerty et al. ..... 220/516
3,184,148 A 5/1965 Poupitch
D201,257 S 6/1965 Vidal
3,247,996 A 4/1966 Garcia
3,283,947 A 11/1966 Cornelius
3,297,190 A 1/1967 Cloyd
D208,111 S 7/1967 Vidal
3,332,574 A 7/1967 Earp
3,333,727 A 8/1967 Belcher et al.
3,333,729 A 8/1967 Rabb
3,334,767 A 8/1967 Cornelius et al.
3,349,943 A 10/1967 Box
D209,864 S 1/1968 Versteeg et al.
3,376,998 A 4/1968 Cornelius
3,384,261 A 5/1968 Austin
3,390,801 A 7/1968 Adomat
3,391,814 A 7/1968 Box
3,391,815 A 7/1968 Box
3,392,869 A 7/1968 Needt
3,416,694 A 12/1968 Bebb
3,428,207 A 2/1969 Scholler
3,517,852 A 6/1970 Schoeller
3,628,684 A 12/1971 Sere
3,638,824 A 2/1972 Sekiguchi et al.
3,701,449 A 10/1972 Schoeller
3,759,416 A 9/1973 Constantine
D229,674 S 12/1973 Quigg
3,812,996 A 5/1974 Bunnell
3,865,239 A 2/1975 Herolzer et al.
3,949,876 A 4/1976 Bridges et al.
3,991,879 A 11/1976 Hirota
3,998,237 A 12/1976 Kressin et al.
3,998,328 A 12/1976 Box
4,027,796 A 6/1977 Martin
4,037,722 A 7/1977 Bremer
4,040,517 A 8/1977 Torokvei
4,071,162 A 1/1978 Steinlein et al.
4,095,720 A 6/1978 Delbrouck et al.
4,101,049 A 7/1978 Wallace et al.
4,161,259 A 7/1979 Palafox
4,162,738 A 7/1979 Wright
4,202,448 A 5/1980 Jaeger et al.
4,204,596 A 5/1980 Davis
4,319,685 A 3/1982 David
4,344,530 A 8/1982 deLarosiere
D266,709 S 10/1982 Box
4,410,099 A 10/1983 deLarosiere
4,416,373 A 11/1983 deLarosiere
D275,142 S 8/1984 Torokvei
4,538,742 A 9/1985 Prodel
4,548,320 A 10/1985 Box
D283,103 S 3/1986 Cushing et al.
4,585,137 A * 4/1986 Poutiainen et al. ..... 220/518
D284,841 S 7/1986 Rowland et al.
D289,938 S 5/1987 Warwick
D291,178 S 8/1987 Toms
4,700,836 A 10/1987 Hammett
4,700,837 A 10/1987 Hammett
D295,107 S 4/1988 Frost
4,773,554 A 9/1988 Warwick
4,789,063 A 12/1988 Hammett
4,848,580 A 7/1989 Wise
D304,123 S 10/1989 Warwick
4,899,874 A 2/1990 Apps et al.
4,911,303 A 3/1990 Andersson
4,928,841 A 5/1990 Arthurs
4,932,532 A 6/1990 Apps et al.
4,978,000 A 12/1990 Mohr
4,978,002 A 12/1990 Apps et al.
D313,493 S 1/1991 Apps et al.
D317,670 S 6/1991 Apps
D318,552 S 7/1991 Apps
5,031,774 A 7/1991 Morris et al.
D319,129 S 8/1991 Apps et al.
D320,298 S 9/1991 Apps et al.
5,060,819 A 10/1991 Apps
5,071,026 A 12/1991 Apps
5,096,085 A 3/1992 Eek et al.
D325,279 S 4/1992 Apps
5,105,948 A 4/1992 Morris et al.
D326,749 S 6/1992 Apps et al.
D327,357 S 6/1992 Rehrig
D327,972 S 7/1992 Apps et al.
D329,931 S 9/1992 Apps
D329,932 S 9/1992 Apps
5,184,748 A 2/1993 Apps
5,267,649 A 12/1993 Apps et al.
5,305,884 A 4/1994 Apps et al.
5,316,172 A 5/1994 Apps et al.
5,320,245 A 6/1994 Apps et al.
5,335,814 A 8/1994 Hepp
D350,438 S 9/1994 Apps et al.
5,351,814 A 10/1994 Apps
5,377,862 A 1/1995 Oakes et al.
5,405,042 A 4/1995 Apps et al.
5,421,477 A 6/1995 Hammett
D360,758 S 8/1995 Umiker
D361,431 S 8/1995 Koefelda
5,465,843 A 11/1995 Koefelda
5,487,487 A * 1/1996 Hammett ..... 220/509
5,495,945 A 3/1996 Apps et al.
5,501,352 A 3/1996 Apps
5,529,176 A 6/1996 Apps et al.
5,575,390 A 11/1996 Apps et al.
D378,249 S 3/1997 Apps et al.
D379,121 S 5/1997 Apps et al.
D379,717 S 6/1997 Apps et al.
D380,613 S 7/1997 Apps et al.
D380,901 S 7/1997 Apps et al.
5,651,461 A 7/1997 Apps et al.
5,660,279 A 8/1997 Apps et al.
5,702,022 A * 12/1997 Umiker ..... 220/509
5,704,482 A 1/1998 Apps et al.
5,769,230 A 6/1998 Koefelda
D395,954 S 7/1998 Apps et al.
D399,060 S 10/1998 Apps et al.
D400,012 S 10/1998 Apps
5,823,376 A 10/1998 McGrath
D401,764 S 12/1998 Apps et al.
5,842,572 A 12/1998 Apps et al.
D404,204 S 1/1999 Apps
5,855,277 A 1/1999 Apps et al.
D410,778 S 6/1999 Apps et al.
D412,399 S 8/1999 Apps et al.
5,964,343 A 10/1999 Steiner
5,971,204 A 10/1999 Apps
5,979,654 A 11/1999 Apps
D417,784 S 12/1999 Umiker
6,006,912 A 12/1999 McGrath
D420,220 S 2/2000 Apps et al.
6,047,844 A 4/2000 McGrath
6,073,793 A * 6/2000 Apps et al. ..... 220/509
6,079,554 A 6/2000 Hammett et al.
6,112,938 A 9/2000 Apps
6,131,730 A 10/2000 Hsu
6,189,734 B1 2/2001 Apps et al.
6,237,758 B1 5/2001 Hsu
D446,015 S 8/2001 Apps
D461,957 S 8/2002 Hammett
D462,522 S 9/2002 Apps et al.
6,454,120 B1 9/2002 Hammett
6,457,599 B1 10/2002 Apps et al.
D465,417 S 11/2002 Apps
D466,018 S 11/2002 Apps
D468,634 S 1/2003 Hammett
D483,946 S 12/2003 Koefelda

(56) References Cited

U.S. PATENT DOCUMENTS

| | | | | |
|---|---|---|---|---|
| D485,756 | S | 1/2004 | Apps | |
| D487,634 | S | 3/2004 | Apps et al. | |
| D494,867 | S | 8/2004 | Apps | |
| 6,851,563 | B1 | 2/2005 | Lipari | |
| D505,014 | S | 5/2005 | Apps et al. | |
| 6,892,885 | B2 | 5/2005 | Apps et al. | |
| 6,899,247 | B1 | 5/2005 | Koefelda et al. | |
| D507,880 | S | 8/2005 | Hassell et al. | |
| 6,966,442 | B2 | 11/2005 | Hassell et al. | |
| 7,017,746 | B2 | 3/2006 | Apps | |
| 7,086,531 | B2 | 8/2006 | Apps et al. | |
| 7,097,033 | B2 | 8/2006 | Koefelda et al. | |
| 7,128,234 | B2 | 10/2006 | Apps et al. | |
| 7,207,458 | B1 | 4/2007 | Koefelda et al. | |
| 7,252,196 | B1 | 8/2007 | Koefelda et al. | |
| 7,281,641 | B2 | 10/2007 | Apps | |
| 7,311,217 | B2 | 12/2007 | Apps | |
| 7,322,475 | B2 | 1/2008 | Hassell et al. | |
| 7,322,486 | B2 | 1/2008 | Koefelda et al. | |
| 7,549,539 | B2 | 6/2009 | Apps | |
| 7,604,122 | B2 | 10/2009 | Apps et al. | |
| 7,677,405 | B2 | 3/2010 | Apps et al. | |
| 7,694,839 | B2 | 4/2010 | Koefelda et al. | |
| D615,758 | S | 5/2010 | Lindstrom | |
| 7,735,676 | B2 | 6/2010 | Ogburn | |
| 7,743,939 | B2 | 6/2010 | Stahl | |
| 7,950,521 | B2 | 5/2011 | Apps | |
| 8,056,753 | B2 | 11/2011 | Koefelda et al. | |
| 2002/0148837 | A1 | 10/2002 | Apps | |
| 2002/0195452 | A1 | 12/2002 | Apps | |
| 2003/0057211 | A1* | 3/2003 | Koefelda et al. | 220/518 |
| 2010/0258467 | A1* | 10/2010 | Apps | 206/427 |

FOREIGN PATENT DOCUMENTS

| | | |
|---|---|---|
| CA | 965056 | 3/1975 |
| CA | 1109433 | 9/1981 |
| DE | 1207268 | 12/1965 |
| EP | 0099827 | 10/1986 |
| EP | 0210712 | 8/1990 |
| EP | 0 464 894 | 1/1992 |
| EP | 1008527 | 11/1999 |
| EP | 2 107 006 | 10/2009 |
| FR | 1285689 | 1/1962 |
| FR | 1350962 | 1/1963 |
| FR | 1350962 | 12/1963 |
| FR | 1351218 | 12/1963 |
| FR | 1518610 | 2/1968 |
| FR | 2302244 | 2/1975 |
| FR | 2302244 | 9/1976 |
| GB | 758817 | 10/1956 |
| GB | 943947 | 12/1963 |
| GB | 1032916 | 6/1966 |
| GB | 1115343 | 5/1968 |
| GB | 1120067 | 7/1968 |
| GB | 1152038 | 5/1969 |
| GB | 1312701 | 4/1973 |
| GB | 1319726 | 6/1973 |
| GB | 1330778 | 9/1973 |
| GB | 2 017 645 | 10/1979 |
| GB | 2079256 | 1/1982 |
| GB | 2135278 | 8/1984 |
| GB | 2158044 | 11/1985 |
| NL | 6505562 | 10/1966 |
| WO | 82/01536 | 5/1982 |
| WO | 96/40566 | 12/1996 |
| WO | 98/07636 | 2/1998 |
| WO | 00/41937 | 7/2000 |
| WO | 2006/026783 | 3/2006 |
| WO | 2009/043038 | 4/2009 |

OTHER PUBLICATIONS

Exhibit 1: Four photos of a prior art case of Rehrig Pacific Company, Model No. PLBC-8-2L-PET-Qd (1984).
Exhibit 2: Two photos of a prior art case of Rehrig Pacific Company for 3 liter PET bottles (1990).
Exhibit 3: Two photos of a prior art case of D.W. Plastics (date unknown).
Exhibit 4: Two photos of a prior art case of International Container Systems, Inc. For 3 liter PET bottles (date unknown).
European Search Report for EP Application No. 09012596.4, Jan. 25, 2010.
European Search Report for EP Application No. 09012612.9, Jan. 8, 2010.
U.S. Appl. No. 12/573,409, filed Oct. 5, 2009, "Stackable Low Depth Tray".
U.S. Appl. No. 12/059,857, filed Mar. 31, 2008, "Stackable Low Depth Tray".
U.S. Appl. No. 12/573,414, filed Oct. 5, 2009, "Stackable Low Depth Tray".
U.S. Appl. No. 12/619,143, filed Nov. 16, 2009, "Low Depth Crate".
U.S. Appl. No. 61/167,776, filed Apr. 8, 2009, "Stackable Low Depth Tray".
U.S. Appl. No. 61/184,768, filed Jun. 5, 2009, "Stackable Low Depth Tray".
Photograph of Pepsi—Blue Crate, Top View.
Photograph of Pepsi—Blue Crate, Bottom View 1.
Photograph of Pepsi—Blue Crate, Bottom View 2.
Photograph of Norseman NPL 405 Crate, Top View.
Photograph of Norseman NPL 405 Crate, Bottom View.
Photograph of Coca Cola Crate, Top View.
Photograph of Coca Cola Crate, Bottom View.
Photograph of 2L Coca Cola "Tulip" Crate, Top View.
Photograph of 2L Coca Cola "Tulip" Crate, Bottom View 1.
Photograph of 2L Coca Cola "Tulip" Crate, Bottom View 2.
Photograph of 2L Coca Cola "Tulip" Crate, Bottom View 3.

* cited by examiner 10
11
24
26
28
30
32
34

20
22
24
26
28
30
32
34
36
38
40
42
44
46
48
50
52

10
14
14
14

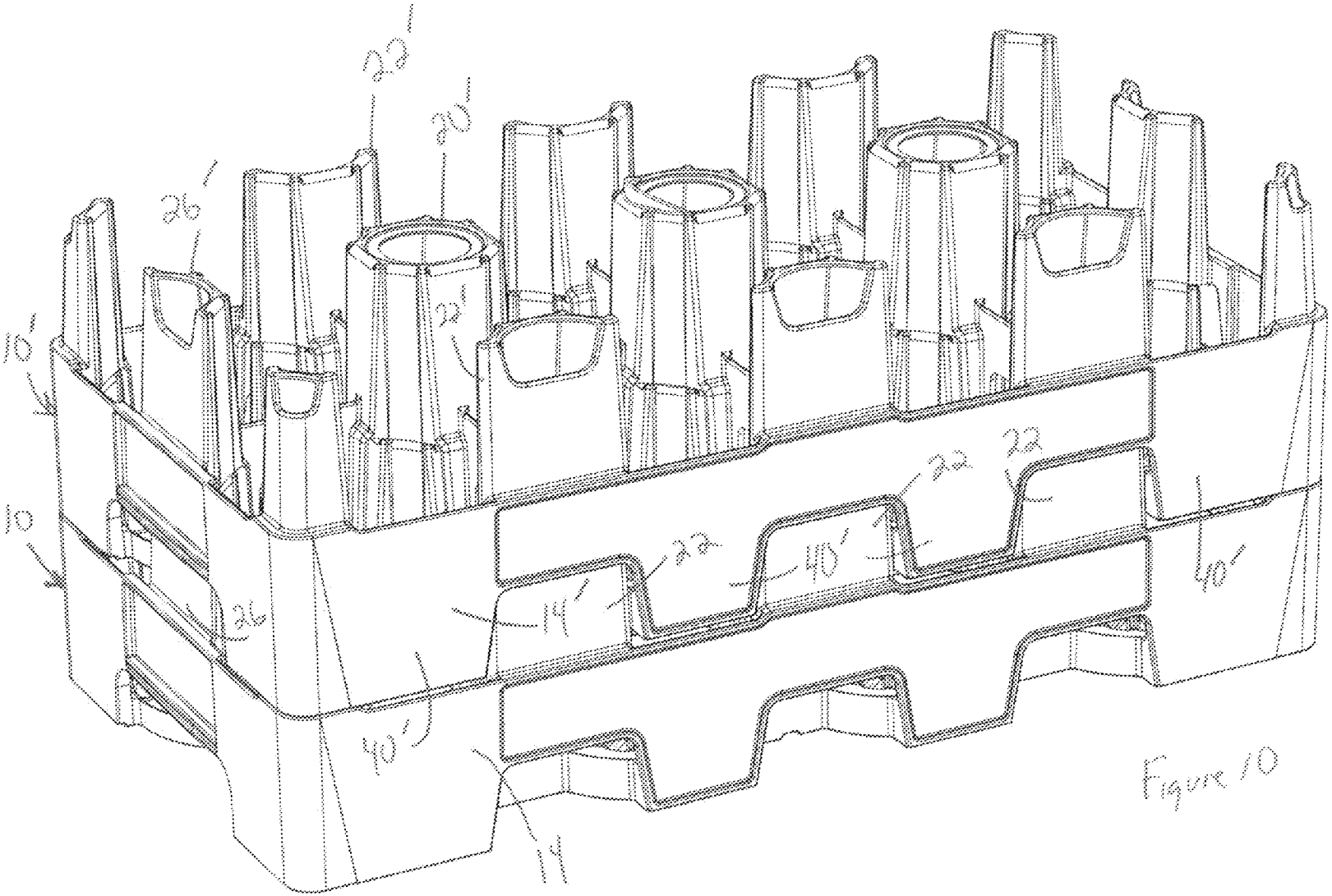
10
10
20
20
20

STACKABLE LOW DEPTH TRAY

BACKGROUND OF THE INVENTION

The present invention relates to a stackable low depth tray for storing and transporting beverages containers, such as bottles.

Plastic bottles are widely used as containers for soft drinks and other beverages. These bottles are often stored and transported in trays, particularly plastic trays. There are many known tray designs that are referred to as "low depth" trays in which the side and end walls are lower than the height of the stored bottles, and in which the bottles support the weight of additional trays and bottles stacked thereon.

SUMMARY OF THE INVENTION

A tray according to one embodiment of the present invention includes a base, a pair of opposed side walls and a plurality of interior columns between the side walls. Dividers connect the interior columns to one another and to the side walls. Side columns project upward from the side walls. The side walls include an upper portion and a plurality of spaced-apart lower portions, thus reducing the weight of the tray while maintaining the stability and rigidity of the tray.

According to another, optional feature of the present invention, the base could include a plurality of base walls connected by co-planar vertical ribs. The dividers include upper wall portions extending continuously between interior columns and/or an interior column and a side column and/or an interior column and an end column. The dividers include spaced apart lower wall portions each connected to one of the vertical ribs connected adjacent base walls.

These and other features of the application can be best understood from the following specification and drawings, the following of which is a brief description.

BRIEF DESCRIPTION OF THE DRAWINGS

FIG. 10 is a perspective view of the tray of FIG. 1 with an identical tray nested therein.

DETAILED DESCRIPTION OF THE PREFERRED EMBODIMENT

Figure 1:
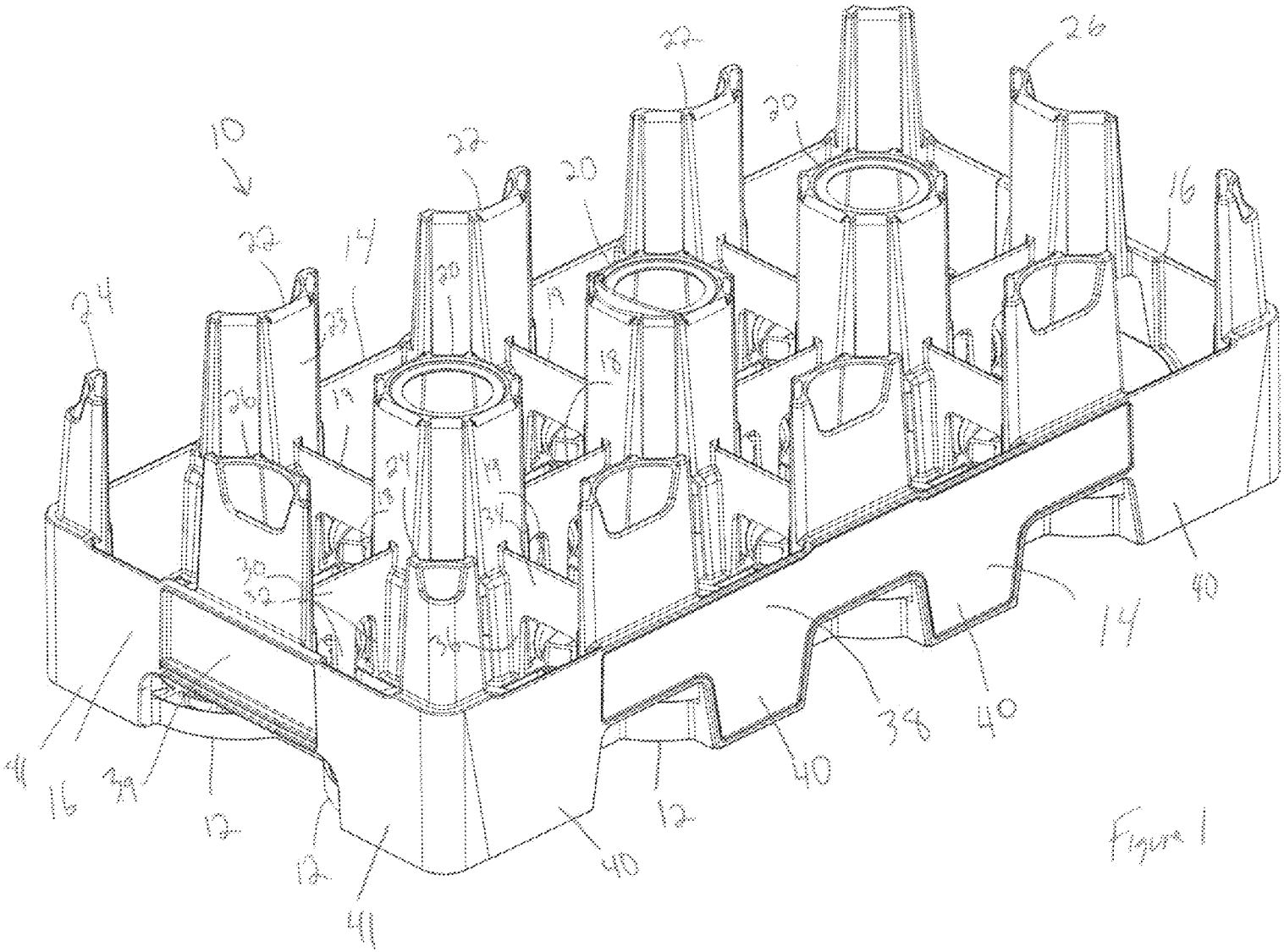
FIG. 1 is a perspective view of a tray according to one embodiment of the present invention.

A tray 10 according to one embodiment of the present invention is shown in FIG. 1. The tray 10 includes a base comprising a plurality (in this example, eight) of base walls 12. The tray 10 further includes a pair of opposed side walls 14 connected by a pair of opposed end walls 16. A plurality of longitudinal dividers 18 and lateral dividers 19, together with the base walls 12, side walls 14 and end walls 16 define a plurality of bottle receiving pockets. A plurality of interior columns 20 extend upwardly between the side walls 14. A plurality of side columns 22 extend upwardly from the side walls 14. Corner columns 24 extend upwardly from the corners, while end columns 26 extend upwardly from the end walls 16.

The longitudinal dividers 18 each have an upper wall portion 30 and a plurality of spaced apart lower wall portions 32 (in this example, three). The lateral dividers 19 each have an upper wall portion 34 and a plurality of spaced apart lower wall portions 36 (in this example, two).

Each side wall 14 includes an upper wall portion 38 and a plurality of spaced-apart lower wall portions 40, each continuous with the upper wall portion 38. The side columns 22 are generally aligned with the spaces between the lower wall portions 40. The bottle receiving pockets and the base walls 12 of the tray 10 are generally aligned with the lower wall portions 40. The end walls 16 each include an upper wall portion 39 and spaced apart lower wall portions 41. The space between the lower wall portions 41 functions as a hand-receiving recess and the upper wall portion 39 functions as a handle for carrying the tray 10.

The upper wall portions 38 of the side walls 14, the upper wall portions 39 of the end walls 16, the upper wall portions 30 of the longitudinal dividers 18 and the upper wall portions 34 of the lateral dividers 19 are generally co-planar. More particularly, the upper edges of the upper wall portions 38, 39, 30, 34 are generally co-planar, as are the lower edges. These upper wall portions 38, 39, 30, 34 together create a solid framework for the tray 10.

Figure 2:
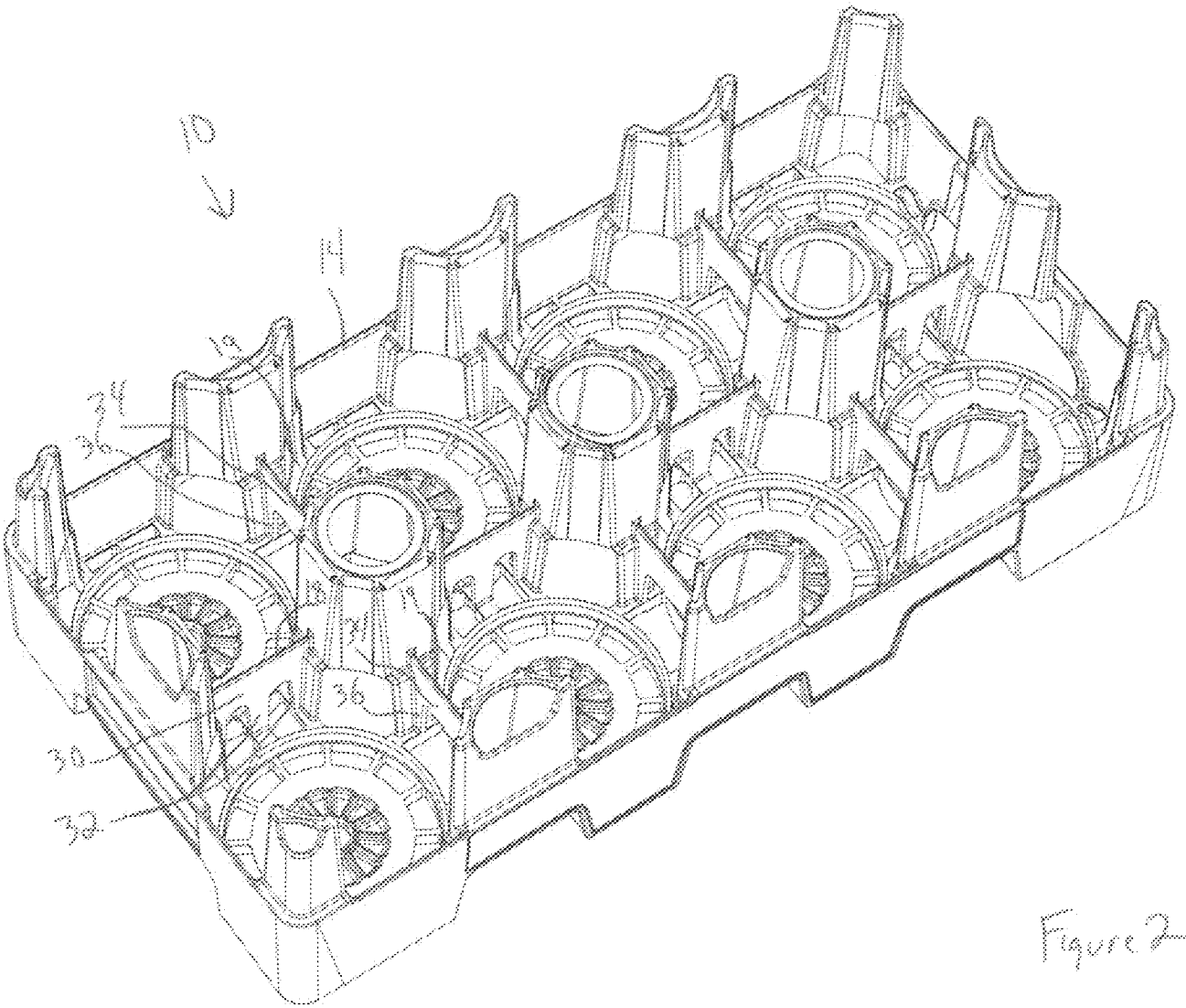
FIG. 2 is another perspective view of the tray of FIG. 1.

As can be seen in FIG. 2, the longitudinal dividers 18 in this example include three spaced apart lower wall portions 32. In this example, the lateral dividers 19 include two spaced apart lower wall portions 36.

Figure 3:
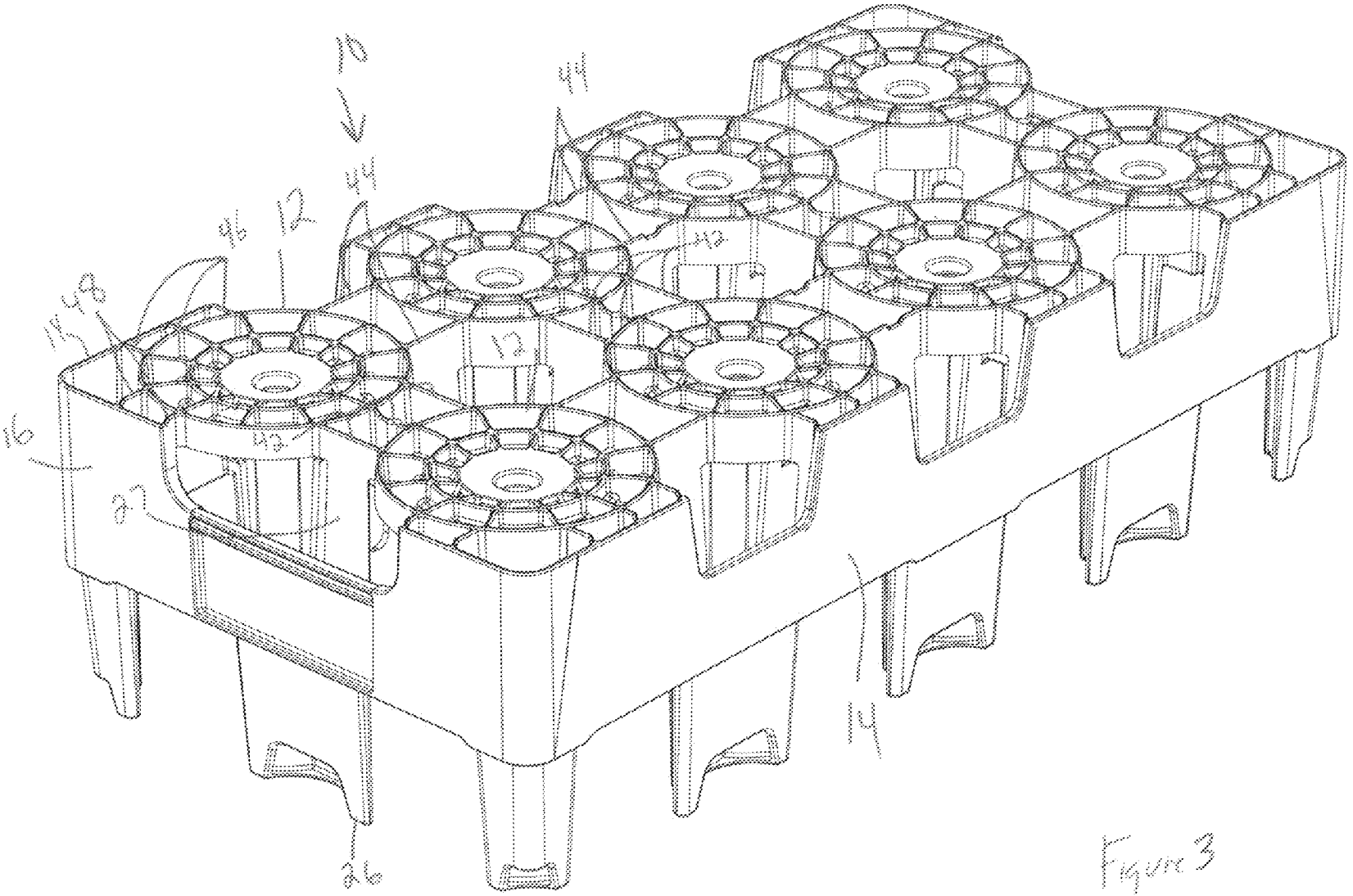
FIG. 3 is a bottom perspective view of the tray of FIG. 1.

FIG. 3 is a bottom perspective view of the tray 10. As shown, the base walls 12 are connected by generally co-planar vertical ribs 42, 44, the lower edges of which are generally co-planar with the lower edges of the base walls 12. Similar vertical ribs 46, 48 connect base walls 12 to the side walls 14 and end walls 16, respectively.

Figure 4:
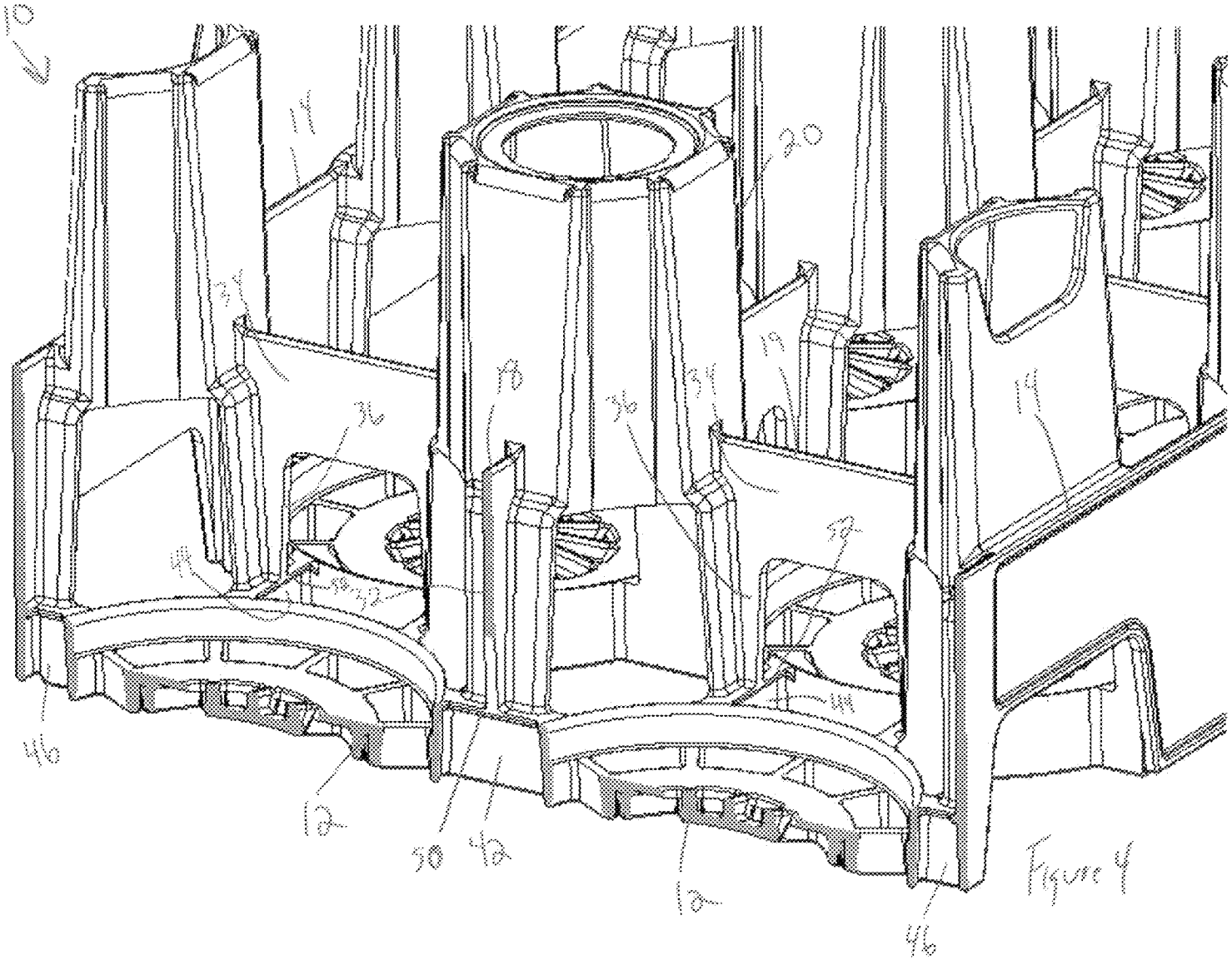
FIG. 4 shows the tray of FIG. 1, partially broken away along a lateral section line.
Figure 5:
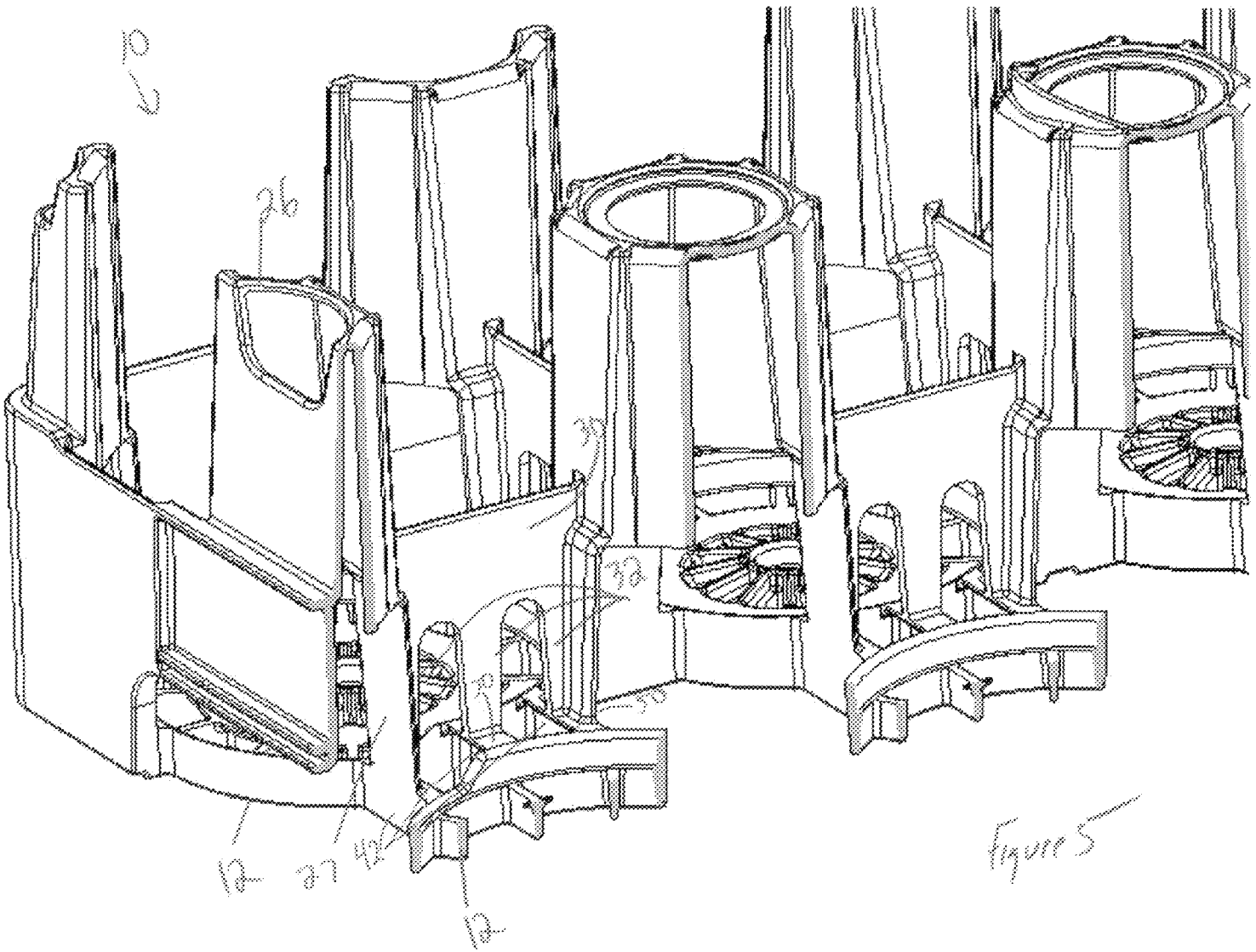
FIG. 5 shows the tray of FIG. 1, partially broken away along a longitudinal section line.

FIG. 4 shows the tray 10 partially broken away along a lateral section line. FIG. 5 shows the tray 10 partially broken away along a longitudinal section line. The lower wall portion 32 of the longitudinal divider 18 connects to the vertical rib 42 via a horizontal rib 50 (also shown in FIG. 5). The lower wall portion 36 of the lateral divider 19 connects to the vertical rib 44 via a horizontal rib 52, as well (FIG. 4).

Figure 6:
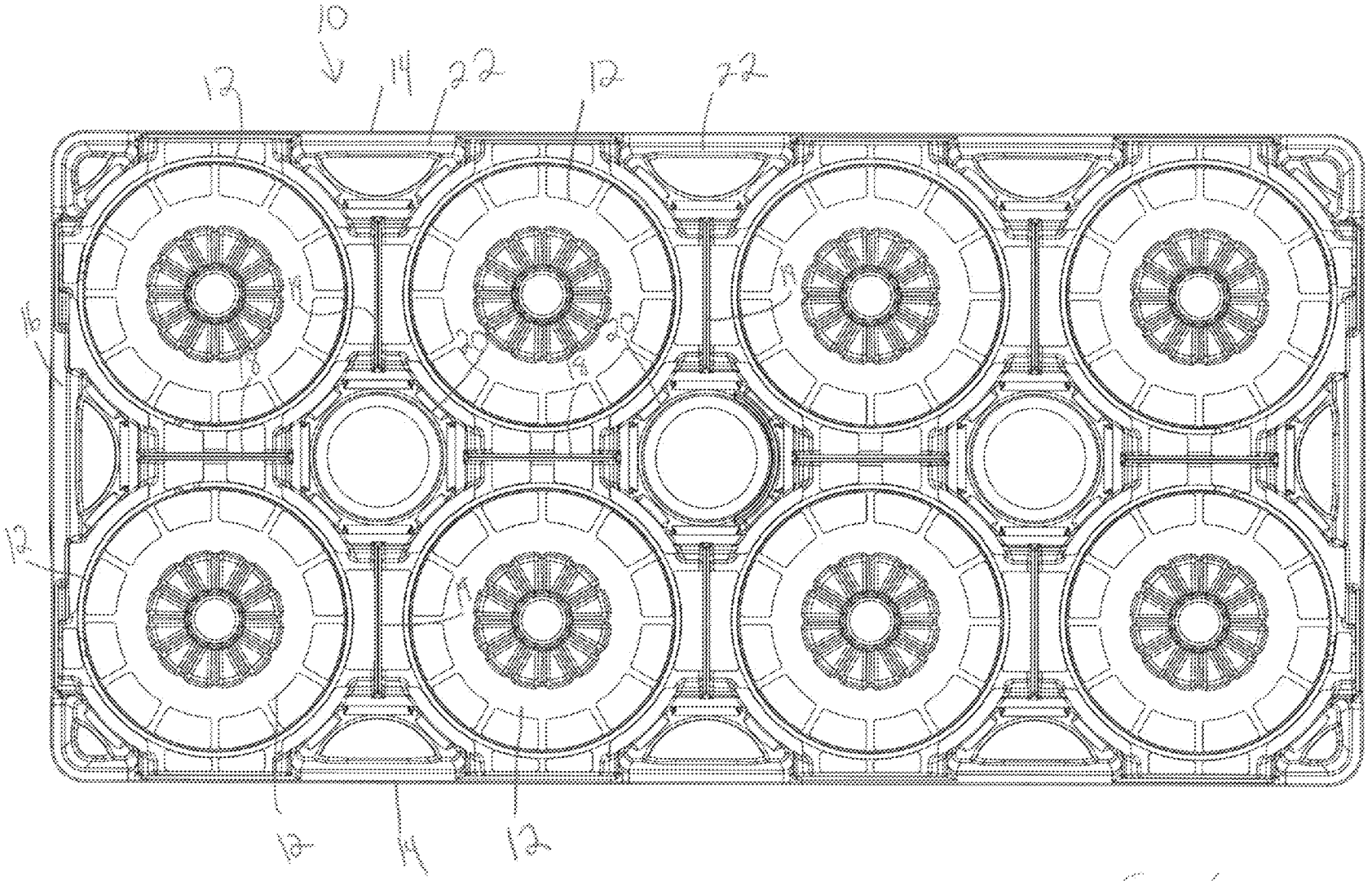
FIG. 6 is a top view of the tray of FIG. 1.
Figure 7:
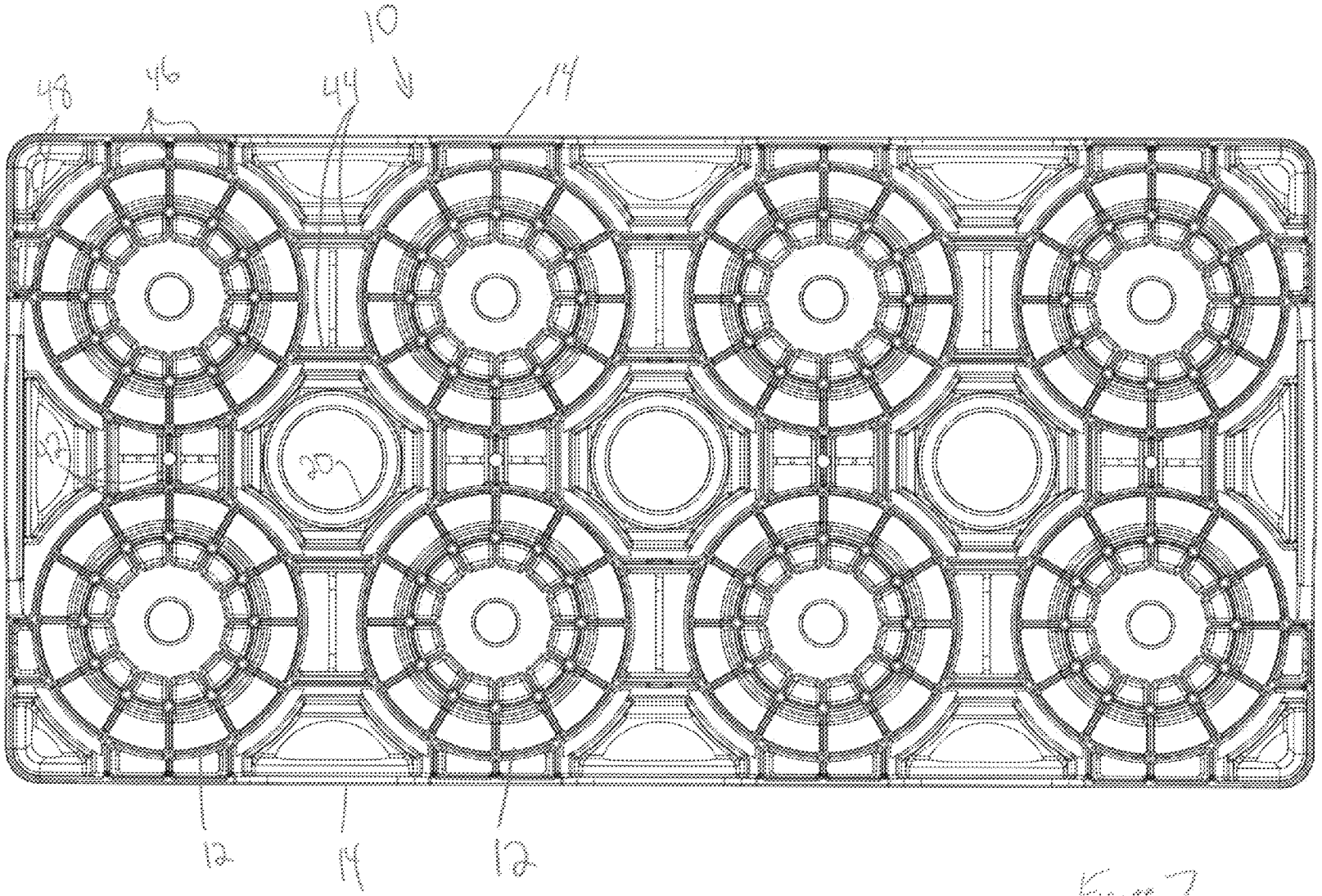
FIG. 7 is a bottom view of the tray of FIG. 1.
Figures 8, 9:
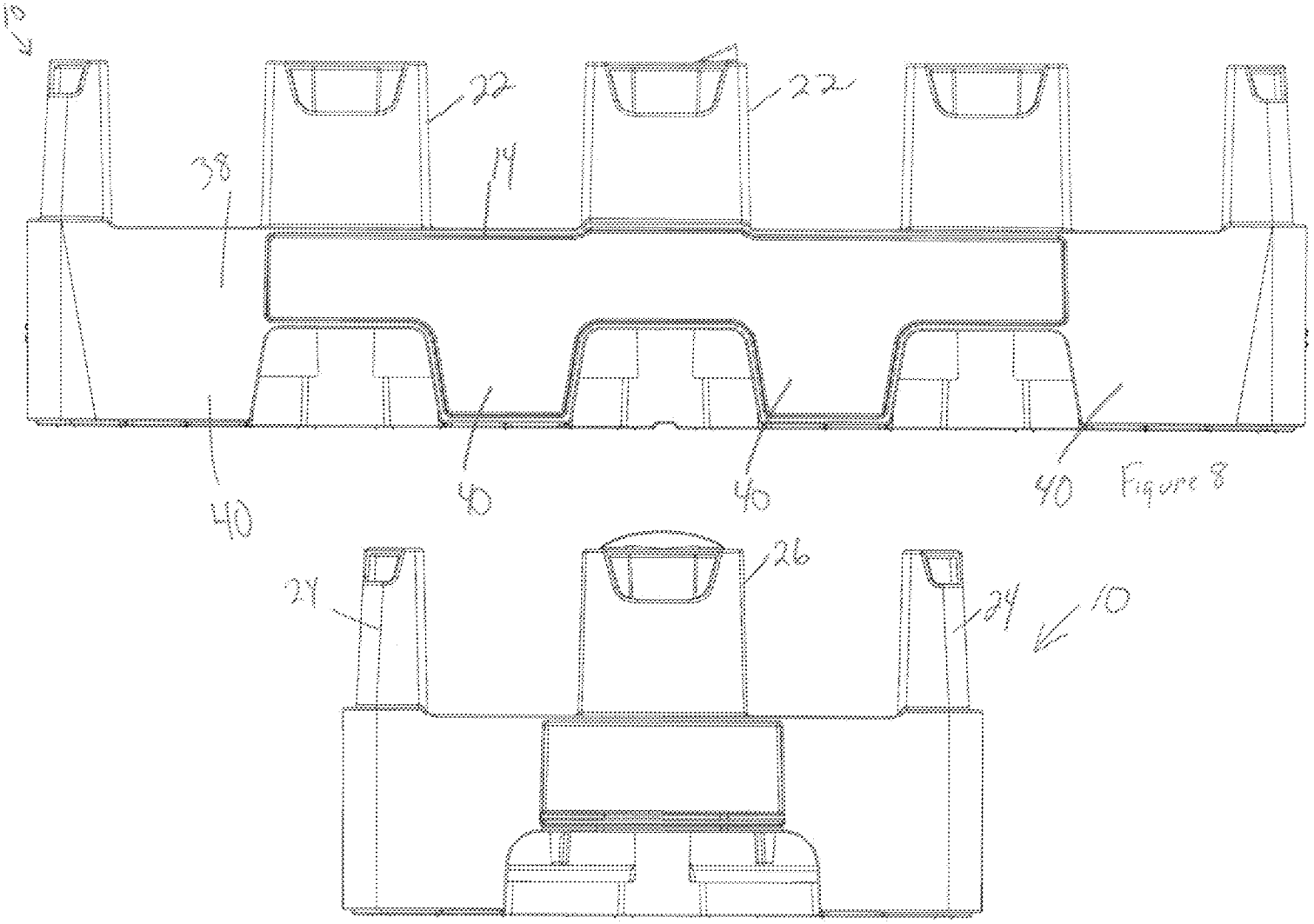
FIG. 8 is a side view of the tray of FIG. 1.
FIG. 9 is an end view of the tray of FIG. 1.

FIG. 6 is a top view of the tray 10. FIG. 7 is a bottom view of the tray 10. FIG. 8 is a side view of the tray 10. FIG. 9 is an end view of the tray 10.

FIG. 10 is a perspective view of the tray 10 with an identical tray 10' nested therein. The lower wall portions 40' of the upper tray 10' are received between the side columns 22 of the lower tray 10. The columns 20 (not visible), 26, 22 are nested into the respective columns 20', 26', 22' of the upper tray 10' to reduce the stacking height when empty.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A tray for storing and transporting bottles comprising:

a base including a plurality of spaced-apart base walls connected to one another by a plurality of vertical base-connecting ribs;

a pair of opposed side walls, the side walls each including an upper portion and a plurality of spaced-apart lower portions, each of the lower portions connected to the base;

a plurality of columns, the plurality of columns including a plurality of interior columns between the side walls, and a plurality of side columns extending up from the side walls between the spaced-apart lower portions of the side walls; and a plurality of dividers connecting the columns to one another, wherein each of the dividers includes an upper vertical wall portion extending continuously from one of the columns to an adjacent column, and wherein each divider further includes a plurality of spaced-apart lower vertical wall portions extending downward from the upper vertical wall portion to connect to one of the plurality of vertical base-connecting ribs.

2. The tray of claim 1 wherein the plurality of dividers includes a plurality of longitudinal dividers connecting the interior columns to one another, the longitudinal dividers each including an upper vertical wall portion extending continuously from one of the interior columns to an adjacent one of the interior columns, each longitudinal divider further including a plurality of spaced-apart lower vertical wall portions each extending downward from the upper vertical wall portion to one of the plurality of vertical base-connecting ribs.

3. The tray of claim 2 wherein each longitudinal divider includes at least three spaced-apart lower vertical wall portions, each connected to a different one of the plurality of vertical base-connecting ribs.

4. The tray of claim 2 wherein the plurality of dividers further includes a plurality of lateral dividers, the lateral dividers each including an upper vertical wall portion extending continuously from one of the interior columns to an adjacent one of the side columns, each lateral divider further including a plurality of spaced-apart lower vertical wall portions each extending downward from the upper vertical wall portion to one of the plurality of vertical base-connecting ribs.

5. The tray of claim 1 further including a pair of opposed end walls connecting the side walls to one another, an end column extending upward from each end wall.

6. The tray of claim 1 further including end walls including upper portions continuous with the upper portions of the side walls around a periphery of the tray.

7. The tray of claim 6 wherein the upper vertical wall portions are generally co-planar with the upper portions of the end walls and the side walls.

8. A tray for storing and transporting bottles comprising:

a base including a pair of spaced-apart base walls each for supporting a bottle thereon, the base walls connected to one another by a plurality of vertical base-connecting ribs that are substantially co-planar with the base walls;

a pair of opposed side walls, the side walls spaced-apart from one another in a lateral direction;

a plurality of interior columns between the side walls, each of the plurality of interior columns including a first wall and a second wall spaced-apart from the first wall in a longitudinal direction generally perpendicular to the lateral direction;

a plurality of side columns extending up from the side walls; and a longitudinal divider connecting a first wall of one of the interior columns to a second wall of an adjacent one of the interior columns and extending transversely therebetween, the longitudinal divider including an upper vertical wall portion extending continuously from the one interior column to the adjacent interior column, the longitudinal divider further including a plurality of spaced-apart lower vertical wall portions each extending downward from the upper vertical wall portion to connect to one of the plurality of vertical base-connecting ribs.

9. The tray of claim 8 wherein the longitudinal divider includes at least three spaced-apart lower vertical wall portions, each connected to a different one of the plurality of vertical base-connecting ribs.

10. The tray of claim 9 wherein each spaced-apart lower vertical wall portion is connected to a different one of the plurality of vertical base-connecting ribs via a respective horizontal rib.

11. The tray of claim 10 wherein the horizontal ribs define planes generally perpendicular to the planes defined by the vertical ribs.

12. The tray of claim 9 wherein each spaced-apart lower vertical wall portion is connected to a different one of the plurality of vertical base-connecting ribs.

13. The tray of claim 8 including a second longitudinal divider connecting a first wall of the adjacent one of the interior columns to a second wall of a third interior column and extending transversely therebetween, the second longitudinal divider including an upper vertical wall portion extending continuously from the one interior column to the adjacent interior column, the second longitudinal divider further including a plurality of spaced-apart lower vertical wall portions each extending downward from the upper vertical wall portion to connect to one of the plurality of vertical base-connecting ribs.

14. A tray for storing and transporting bottles comprising:

a base including a pair of spaced-apart base walls each for supporting a bottle thereon, the base walls connected to one another by a plurality of vertical base-connecting ribs that are substantially co-planar with the base walls;

a pair of opposed side walls, the side walls spaced-apart from one another in a lateral direction;

a plurality of interior columns between the side walls, each of the plurality of interior columns including a first wall and a second wall spaced-apart from the first wall in a lateral direction;

a plurality of side columns extending up from the side walls, the side columns each including a wall facing toward the interior columns; and a lateral divider connecting a first wall of one of the interior columns to a wall one of the side columns and extending transversely therebetween, the lateral divider including an upper vertical wall portion extending continuously from the one interior column to the one side column, the lateral divider further including a plurality of spaced-apart lower vertical wall portions each extending downward from the upper vertical wall portion to connect to one of the plurality of vertical base-connecting ribs.

15. The tray of claim 14 wherein the lower vertical wall portions extend transversely from the one interior column and from the one side column.

16. The tray of claim 14 wherein the lower vertical wall portions are each connected to a different one of the plurality of vertical base-connecting ribs.

17. The tray of claim 16 wherein there are two spaced-apart lower vertical wall portions.

18. The tray of claim 16 wherein each lower vertical wall portion is connected to a different one of the plurality of vertical base-connecting ribs via a respective horizontal rib.

19. The tray of claim 18 wherein the horizontal ribs define planes generally perpendicular to the planes defined by the vertical ribs.

20. The tray of claim 14 including a second lateral divider connecting a second wall of the one of the interior columns to a wall one of another of the side columns and extending transversely therebetween, the second lateral divider including an upper vertical wall portion extending continuously from the one interior column to the one side column, the second lateral divider further including a plurality of spaced-apart lower vertical wall portions each extending downward from the upper vertical wall portion to connect to one of the plurality of vertical base-connecting ribs.

21. The tray of claim 14 wherein the walls of the side columns are spaced inward from an outermost wall of the tray.

* * * * *

UNITED STATES PATENT AND TRADEMARK OFFICE

CERTIFICATE OF CORRECTION

PATENT NO. : 8,636,142 B2
APPLICATION NO. : 12/556616
DATED : January 28, 2014
INVENTOR(S) : William P. Apps It is certified that error appears in the above-identified patent and that said Letters Patent is hereby corrected as shown below:

IN THE CLAIMS:

In claim 14, column 4, line 46; after "wall" insert --of--

Signed and Sealed this
Sixteenth Day of September, 2014

Michelle K. Lee

Michelle K. Lee
*Deputy Director of the United States Patent and Trademark Office*